US011519073B1

(12) United States Patent
Miller et al.

(10) Patent No.: US 11,519,073 B1
(45) Date of Patent: Dec. 6, 2022

(54) SOL-GEL COATED OVEN AND COATING PROCESS

(71) Applicant: Lincoln Industries, Inc., Lincoln, NE (US)

(72) Inventors: Jeremy Miller, Seward, NE (US); Adam Matzner, Lincoln, NE (US)

(73) Assignee: Lincoln Industries, Inc., Lincoln, NE (US)

( * ) Notice: Subject to any disclaimer, the term of this patent is extended or adjusted under 35 U.S.C. 154(b) by 0 days.

(21) Appl. No.: 17/067,380

(22) Filed: Oct. 9, 2020

Related U.S. Application Data

(60) Provisional application No. 62/913,042, filed on Oct. 9, 2019.

(51) Int. Cl.
*C23C 18/12* (2006.01)

(52) U.S. Cl.
CPC ..... *C23C 18/1254* (2013.01); *C23C 18/1208* (2013.01); *C23C 18/1225* (2013.01); *C23C 18/1241* (2013.01)

(58) Field of Classification Search
CPC ..... F24C 15/005
See application file for complete search history.

(56) References Cited

U.S. PATENT DOCUMENTS

| | | | | |
|---|---|---|---|---|
| 2003/0118624 | A1* | 6/2003 | Jackson | C04B 41/5027 424/405 |
| 2003/0138661 | A1* | 7/2003 | Souchard | A47J 36/02 428/689 |
| 2005/0170099 | A1* | 8/2005 | Gadow | B05B 13/0654 427/446 |
| 2008/0118745 | A1* | 5/2008 | Endres | C09D 183/04 428/336 |

FOREIGN PATENT DOCUMENTS

| | | | | |
|---|---|---|---|---|
| CA | 2722559 | A1 | 6/2011 | |
| CN | 106584033 | A | 4/2017 | |
| EP | 0945682 | A1 | 9/1999 | |
| WO | WO-2017138781 | A1 * | 8/2017 | F24C 15/00 |

* cited by examiner

*Primary Examiner* — Tabatha L Penny
(74) *Attorney, Agent, or Firm* — Schwegman Lundberg & Woessner, P.A.

(57) ABSTRACT

A methods and systems are disclosed for coating a large oven cavity. A method of coating an oven includes spraying a coating at room temperature onto a plurality of surfaces in the oven cavity in one or more layers and manipulating the oven to position the plurality of surfaces while spraying in various embodiments. An article includes an oven having a cavity, where the cavity has a surface with a volume of about 3 $ft^3$ to about 7 $ft^3$, and a coating on the surface of the cavity, the coating including a sol-gel ceramic.

11 Claims, 2 Drawing Sheets

SOL-GEL COATED OVEN AND COATING PROCESS

CROSS-REFERENCE TO RELATED APPLICATION

This patent application claims the benefit of U.S. Provisional Patent Application No. 62/913,042, filed Oct. 9, 2019, entitled "SOL-GEL COATED OVEN AND COATING PROCESS", which is incorporated by reference herein in its entirety.

TECHNICAL FIELD

Embodiments described herein generally relate to cookware coatings. One specific example includes oven cavity coatings.

BACKGROUND

Cookware is often coated to provide heat and non-stick protection and longer wear. In particular, sol-gel coating methods allow for good adhesion to the surface being coated, with less delamination. Sol-gel coating processes produce ceramic coatings by converting a gel-like material to a solid coating.

Sol-gel coating methods can be used were the cookware surface is pre-heated and the sol-gel applied to create a ceramic coating during a finite time prior to cool down. Due to time restrictions on the application of the coating, sol-gel coating techniques are generally used on smaller scale cookware or small cavities, such as microwave ovens.

BRIEF DESCRIPTION OF THE DRAWINGS

In the drawings, which are not necessarily drawn to scale, like numerals may describe similar components in different views. Like numerals having different letter suffixes may represent different instances of similar components. Some embodiments are illustrated by way of example, and not of limitation, in the figures of the accompanying drawings, in which.

DETAILED DESCRIPTION

In the following detailed description of the invention, reference is made to the accompanying drawings that form a part hereof and in which are shown, by way of illustration, specific embodiments in which the invention may be practiced. These embodiments are described in sufficient detail to enable those skilled in the art to practice the invention. Other embodiments may be utilized, and structural, logical, and electrical changes may be made.

Sol-gel coating methods have been applied to small cavities and cookware. However, sol-gel coating techniques typically require pre-heating of the surface to which the coating will be applied, limiting the window of time in which the coating can be applied before the surfaces cools down. For this reason, sol-gel coating techniques are not used on large oven cavities, as the applied coating could dry prior to application of the entire coating.

Discussed herein are methods of applying a sol-gel coating to an oven cavity with a large surface area and volume, without pre-heating the surface of the oven cavity. The method can allow for even, smooth application of a ceramic coating using sol-gel techniques throughout the large oven cavity.

Figure 1:
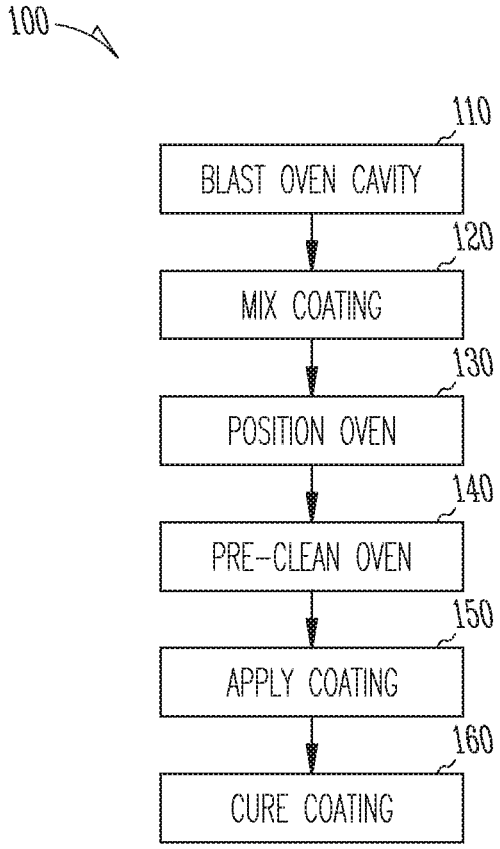
FIG. 1 is a flow chart depicting a method of coating an oven cavity in various embodiments.

FIG. 1 is a flow chart depicting a method 100 of coating an oven cavity in various embodiments. Method 100 includes steps 110 to 160.

First, in step 110, the oven cavity can optionally be blasted with grit material to clean the surfaces of the oven cavity. For example, the oven cavity can be blasted with aluminum oxide or silicon dioxide. The blasting can occur at a slightly heated temperature, for example, about 30° C. to about 50° C. The grit material can then be blown out of the oven cavity to provide clean surfaces to coat. Optionally, the oven cavity can be pre-cleaned before grit blasting to allow a clean surface. In this case, appropriate cleaners can be used on the interior surfaces of the oven. In other cases, the oven cavity can be pre-treated prior to blasting, as desired.

Next, in step 120, the coating mixture can be mixed. The coating mixture can be a sol-gel prepared ceramic coating. Sol-gel techniques are used to prepare ceramic or glass materials with controlled microstructures, often starting with small molecules to produce solid materials. Sol-gel processes involve conversion of monomers into a colloidal solution ("sol") that acts as a precursor for an integrated network ("gel") of discrete particles or polymers. The sol can gradually evolve toward the formation of a gel-like diphasic system containing both liquid phase and solid phase components. Eventually, the applied chemistry can harden to a coating. In some cases, the coating can be dried after the gel is applied to harden the coating.

Here, the sol-gel coating mixture can contain precursors to a ceramic coating; for example, a silicon or titanium oxide based mixture can be used. The sol-get coating mixture can additionally contain aesthetically pleasing additives, such as reflective or pigmented particles.

The components of the coating can be pre-mixed and loaded into a sprayer or other applicator (e.g., a brush, spin applicator, or other as appropriate) for coating the oven cavity. In some embodiments, the coating mixture can be filtered before coating the oven cavity.

In step 130, the oven is positioned. The oven can be, for example, placed on a turn table or other moveable surface that can allow for manipulation of oven surface placement such that a user (or robotic arm) can reach and coat each of the surfaces inside the oven cavity. In some examples, the user can be a human user. In others, the user can be robotic, such as a robotic arm configured to spray the coating onto the surfaces of the oven cavity.

In step 140, the oven is optionally pre-cleaned. This can include, for example, blowing off the oven cavity to remove dust or other particle build-up, and can be applied to both the inside of the oven cavity and to any embellishments on the surfaces of the oven cavity.

Next, in step 150, the coating is applied onto the oven cavity. The coating can be applied without pre-heating the oven, at, for example, room temperature. This can be, for example, about 20° C. to about 30° C., or up to about 25° C. Additional heating or temperature regulation does not need to be used before or during application of the coating.

In contrast, pre-heating the oven cavity can interfere with the coating process. In a large oven cavity, heated surfaces cool down over time. Without sufficient time to evenly coat the entire, large, oven cavity, the coating would begin to cool down and settle prior to the entire cavity being coated. For example, a first layer of the coating would dry prior to application of a second layer. Due to the nature of sol-gel ceramic coatings, the second layer would not adhere well to the dried first layer. Thus, heating or pre-heating the oven cavity prior to coating can prevent a large oven cavity from being thoroughly and evenly coated.

The coating can be applied in multiple layers. For example, a base coat can be applied first. The base coat can be applied in light layers to each of the surfaces of the oven cavity. A top coat can be applied on top of the base coat in a wet on wet process, e.g., without drying of the coating in between applications. In some embodiments, one or more intermediate coats can be applied between the base coat and the top coat.

Generally, the base, intermediate, and top coats, can include the sol-gel coating technique components, such as the precursors to a ceramic coating. The base, intermediate, and top coats can have slightly varying chemistry and/or thickness depending on the requirements for the coating. The top coat can in some cases can additionally contain pigmentation or other aesthetic components, such as reflective particles.

Application of the base coat can be done in a specific order to ensure even coating of each of the surfaces of the oven cavity and any embellishments or embossing on those surfaces. For example, the turntable can be positioned to allow even spraying of the base coat onto the inside top surface (see, e.g., FIG. 2, 210). The turntable can then be positioned to spray the first side surface (220) and second side surface (230) of the oven cavity.

The top surface and side surfaces can often include embossing for oven racks (222, 232), and positioning of the turntable allows for even coating over those embosses. Moreover, embossing, embellishments, or other portions of the surfaces which have complex topography, can take additional time and attention to detail to coat properly. Because of this, the coating layers should not be dried between application of coating layers; coating can be done at lower or room temperature, such as less than 25° C. As discussed above, pre-heating the oven cavity surfaces can allow coating portions or layers to dry too quickly, preventing additional coats or layers from adhering to the dried coating. Particularly around embossing, wet-on-wet application of coating layers is useful to fully cover embossed details.

The base coat can be applied to the top surface and side surfaces in multiple layers until the desired thickness is reached.

The oven can then be spun around on the turntable so that the user (or robotic arm) is facing the inside bottom surface (240) of the oven. The bottom surface can include, for example, embellishments (242) such as textures or places for insertion of racks or heaters. Like the earlier surfaces, the bottom surface can be sprayed with multiple layers of the base coat until the desired thickness is reached. When the bottom surface (240) is facing the user (or robotic arm), the side surfaces (220, 230) can be coated from the opposite side, such that the bottoms of the embosses are coated with the base coat. This can ensure the oven rack holders are coated on both sides.

Next, the internal back surface (250), which is facing up while the oven is on the turntable, can be coated. The back surface (250) can potentially have embossing to hold oven racks. Like the other surfaces, the back surface (250) can be coated with multiple light layers until desired coverage is achieved.

While coating the oven cavity surfaces, the corners of the oven cavity do not necessarily need to be coated separately. Generally, overspray from coating of each of the side, top, and bottom surfaces can provide sufficient, even coating of the corners in the oven cavity.

Optionally, the inside of an oven face can be coated with the base coat. The oven face can be a removable oven face (e.g., a door), or attached to the oven via hinges or other normal methods. The internal surface of the oven face can be coated similarly to the other surfaces discussed above.

After application of the base coat, an intermediate coat can optionally be applied in the same fashion. Subsequently, a top coat can be applied in the same order as the base coat. The sprayer and turntable can be manipulated to avoid bumping, smudging, or changing of the base coat. Specifically, the base coat is left "wet" after application without allowing drying. This can be accomplished in part by not heating the oven cavity, and instead proceeding at room temperature. For this reason, the user, sprayer, and turntable could potentially leave marks or smudges in the "wet" base coat if incorrectly positioned.

The intermediate and/or top coats can be applied to the base coat in a "wet on wet" fashion, without drying, curing, heating, or hardening of the base coat before application of the subsequent coats. Thus, the finished coating can potentially have a gradient of coating layers, as opposed to distinct layers once finished.

In step 160, the coating is dried. The oven cavity with the applied coating can be flashed at about 50° C. to about 80° C. for about five minutes, and subsequently dried at about 260° C. to about 320° C. The coating can harden during drying. During drying, some or all of the remaining solvent or liquid phase can be removed from the sol-gel ceramic, leaving a dense ceramic coating.

Figure 2:
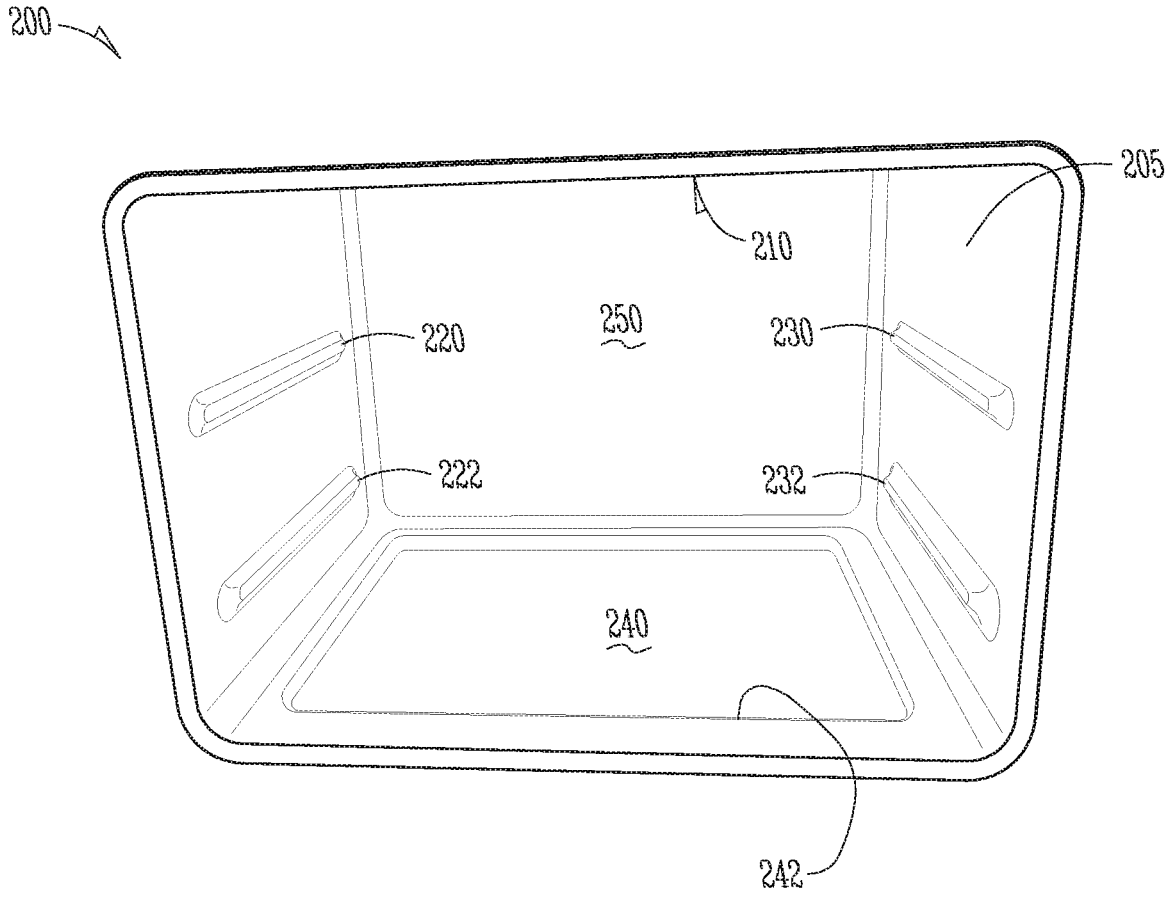
FIG. 2 is a perspective view of a coated oven cavity.

FIG. 2 is a perspective view of a coated oven cavity. In FIG. 2, oven 200 includes cavity 205. Cavity 205 includes top surface 210, first side 220, second side 230, bottom 240, back 250, and front side 260. A coating is inside cavity 205.

Oven 200 can be, for example, an industrial size oven. The oven 200 can be made of a metallic material, such as steel or aluminum, stainless steel, enamel, or iron. The oven 200 can have a cavity 205 with a volume of about 2 $ft^3$ to about 7 $ft^3$ (e.g., about 3 $ft^3$ to about 5 $ft^3$). The large, industrial size of the oven cavity necessitates a spraying method that does not use pre-heating or heating prior to application of the sol-gel ceramic. If the oven cavity was heated, the surfaces, including embossing or embellishments, would dry at an uneven rate. This could result in a base coat that dries prior to application of an intermediate or top coat, preventing adhesion of the top coat to the base coat. This would lead to an uneven coating that may not full cover and protect embosses.

The coating inside cavity 205 can be, for example, a ceramic coating formed by a sol-gel process. Ceramic coatings formed by sol-gel processes can have a distinct microstructure. The coating can be a ceramic coating, such as a silicon or tungsten oxide based coating. The coating can have one or more layers, including a base coat and top coat, and optionally one or more intermediate coats. The total coating can have a gradient effect from the base coat to the top coat.

The coating can have a thickness that is even throughout the oven cavity. The coating can be even throughout the oven cavity 205, with substantially no overspray, and no portions with larger thickness than others. The coating can have substantially no cracking, both after application of the coating when the coating is cold, and when the oven cavity is heated during operation. The evenness of the coating, including the adherence of the base coat to the top coat, prevents such cracking that can occur from impurities or imperfections.

The coating can have, for example, a water contact angle of about 90 degrees to about 110 degrees (e.g. about 91 to about 104), as measured by ASTM procedure D7334. The coating can have, for example, a gloss of about 20 gloss units to about 60 gloss units (e.g. about 25 to about 55), as measured on a 60 degree scale with ASTM procedure D523.

The oven can have, for example, an initial (after grit-blasting) roughness of about 1.0 to about 3.0 microns Ra as measured by ISO procedure 4288. The coating can have, for example, a coated roughness of about 1.5 microns to about 2.5 microns Ra as measured by ISO procedure 4288.

The smoothness, including water contact angle, gloss hardness, and surface roughness of the coating is due to the application process without heating. The lower temperature (such as below 25° C., or room temperature) allows for the applied sol-gel ceramic to spray more evenly and settle onto the surface. The surface tension of the sol-gel ceramic material allows for coalescing of the ceramic coating over this longer time period that does not include premature drying. This results in a smoother, more dense, ceramic coating.

The oven cavity coating and method of coating discussed herein allow for a uniform, strong coating in a large, industrial oven cavity due to the coating that occurs at a low temperature, such as less than 25° C. The coating can perform evenly across temperatures when the oven cavity is in use (e.g., heated). The method of producing the coating cannot include pre-heating, which allows for more even distribution of the coating throughout the oven cavity.

To better illustrate the method and apparatuses disclosed herein, a non-limiting list of embodiments is provided here:

Example 1 includes a method of coating an oven comprising: spraying a coating at room temperature onto a plurality of surfaces in the oven cavity in one or more layers and manipulating the oven to position the plurality of surfaces while spraying.

Example 2 includes Example 1, further comprising positioning the oven on the turntable such that a backside of the oven is down, wherein manipulating the oven comprises moving the turntable.

Example 3 includes Example 1, wherein the plurality of surfaces comprise: a. a topside of the oven cavity, b. a first side of the oven cavity, c. a second side of the oven cavity, d. a bottom of the oven cavity, e. a back of the oven cavity, and f. a front side of the oven cavity.

Example 4 includes Example 3, wherein spraying the coating onto the plurality of surfaces comprises spraying the surfaces in the order of surfaces a to f.

Example 5 includes Example 1, wherein spraying the coating comprises applying a base layer and a top layer.

Example 6 includes Example 5, wherein spraying the coating further comprises applying an intermediate layer.

Example 7 includes Example 5, wherein spraying the coating comprises spraying the top layer directly onto the base layer without drying the base layer.

Example 8 includes Example 1, wherein applying the coating further comprises evenly coating embellishments and embosses on the plurality of surfaces.

Example 9 includes Example 8, wherein applying the coating comprises coating surfaces containing embellishments and embosses first.

Example 10 includes Example 1, wherein room temperature comprises about 20° C. to about 30° C.

Example 11 includes Example 10, wherein room temperature comprises between 20° C. and 25° C.

Example 12 includes Example 1, wherein the method does not include pre-heating the oven cavity prior to spraying the coating.

Example 13 includes Example 1, further comprising drying the coating in the oven cavity.

Example 14 includes Example 13, wherein drying comprises heating the oven cavity to about 260° C. to about 315° C. for about ten minutes.

Example 15 includes an article comprising: an oven comprising a cavity, wherein the cavity has a volume of about 3 $ft^3$ to about 7 $ft^3$, a coating on the surface of the cavity, the coating comprising a sol-gel ceramic.

Example 16 includes Example 15, wherein the oven cavity comprises a metallic material.

Example 17 includes Example 15, wherein the coating comprises a surface roughness of about 1.5 microns to about 2.5 microns.

Example 18 includes Example 15, wherein the coating comprises a water contact angle of about 91 degrees to about 105 degrees.

Example 19 includes Example 15, wherein the coating comprises a gloss of about 20 gloss units to about 60 gloss units.

Example 20 includes an article made by the process of: spraying a coating at room temperature onto a plurality of surfaces in the oven cavity in one or more layers and manipulating the oven to position the plurality of surfaces while spraying.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A method of coating an oven having an oven cavity and a backside opposite the oven cavity, the method comprising:

positioning the oven on a turntable such that the backside of the oven is down and the oven cavity is up;

spraying one or more components of a sol-gel ceramic coating at room temperature onto a plurality of surfaces in the oven cavity in one or more layers, wherein spraying the coating further comprises evenly coating embellishments and embosses on the plurality of surfaces; and manipulating the oven to position the plurality of surfaces while spraying, wherein manipulating the oven comprises moving the turntable to allow access to one or more corners in the oven cavity, and wherein manipulating the oven comprises moving the turntable to allow access to coating surfaces containing embellishments and embosses first.

2. The method of claim 1, wherein the plurality of surfaces comprise:

a. a topside of the oven cavity;
b. a first side of the oven cavity;
c. a second side of the oven cavity;
d. a bottom of the oven cavity;
e. a back of the oven cavity; and
f. a front side of the oven cavity.

3. The method of claim 2, wherein spraying the coating onto the plurality of surfaces comprises spraying the surfaces in the order of surfaces a to f.

4. The method of claim 1, wherein spraying the coating comprises applying a base layer and a top layer.

5. The method of claim 4, wherein spraying the coating further comprises applying an intermediate layer.

6. The method of claim 4, wherein spraying the coating comprises spraying the top layer directly onto the base layer without drying the base layer.

7. The method of claim 1, wherein room temperature comprises about 20° C. to about 30° C.

8. The method of claim 7, wherein room temperature comprises between 20° C. and 25° C.

9. The method of claim 1, wherein the method does not include pre-heating the oven cavity prior to spraying the coating.

10. The method of claim 1, further comprising drying the coating in the oven cavity.

11. The method of claim 10, wherein drying comprises heating the oven cavity to about 260° C. to about 315° C. for about ten minutes.

* * * * *